US007207451B2

(12) United States Patent
Taylor et al.

(10) Patent No.: US 7,207,451 B2
(45) Date of Patent: Apr. 24, 2007

(54) MOLDED CONTAINER WITH BEADED NECK

(75) Inventors: Larry Taylor, Landisville, PA (US); Sheldon Yourist, York, PA (US)

(73) Assignee: Graham Packaging Company, L.P., York, PA (US)

( * ) Notice: Subject to any disclaimer, the term of this patent is extended or adjusted under 35 U.S.C. 154(b) by 58 days.

(21) Appl. No.: 10/752,538

(22) Filed: Jan. 8, 2004

(65) Prior Publication Data

US 2004/0140284 A1 Jul. 22, 2004

Related U.S. Application Data

(63) Continuation-in-part of application No. 29/156,197, filed on Feb. 26, 2002, which is a continuation-in-part of application No. 29/156,163, filed on Feb. 26, 2002, now Pat. No. Des. 486,739.

(51) Int. Cl.
*B65D 1/02* (2006.01)
*B65D 1/46* (2006.01)

(52) U.S. Cl. ..... 215/42; 215/44

(58) Field of Classification Search ..... 215/40, 215/42, 44, 383, 41, 43
See application file for complete search history.

(56) References Cited

U.S. PATENT DOCUMENTS

| | | | | |
|---|---|---|---|---|
| 2,013,475 | A * | 9/1935 | Orton | 206/229 |
| 2,124,638 | A * | 7/1938 | Sheldon et al. | 215/252 |
| D119,303 | S | 3/1940 | Deletzke | |
| D131,294 | S | 2/1942 | Blunt | |
| D136,997 | S | 1/1944 | Clark | |
| D164,112 | S | 7/1951 | Henderson | |
| 3,015,404 | A * | 1/1962 | Wuyckens | 215/42 |
| 3,235,115 | A * | 2/1966 | Duke | 215/252 |
| D233,828 | S | 12/1974 | Leary | |
| 4,573,599 | A * | 3/1986 | Fillmore | 215/225 |
| 4,739,891 | A * | 4/1988 | Bullock, III | 215/232 |
| 4,941,580 | A * | 7/1990 | Julian | 215/235 |
| 5,027,964 | A * | 7/1991 | Banich, Sr. | 215/252 |
| D331,017 | S | 11/1992 | Chan | |
| D334,143 | S | 3/1993 | Rothfos | |
| D353,335 | S | 12/1994 | Cox | |
| D353,542 | S | 12/1994 | Beaver | |
| 5,411,157 | A * | 5/1995 | King et al. | 215/330 |
| D380,158 | S | 6/1997 | Olivares et al. | |
| D386,611 | S | 11/1997 | Sheu | |
| 5,687,866 | A * | 11/1997 | Luch et al. | 215/256 |

(Continued)

FOREIGN PATENT DOCUMENTS

EP 0000823 A1 * 2/1979

(Continued)

*Primary Examiner*—Sue A. Weaver
(74) *Attorney, Agent, or Firm*—Venable LLP; Keith G. Haddaway

(57) ABSTRACT

A container having a neck that includes an upper sidewall defining an opening, a lower sidewall and a flange radially extending from the neck between said upper and said lower sidewall. Beads are disposed around an outer circumference of the neck on the flange at the junction of the flange and the upper or lower sidewall. The container can have a sidewall that is substantially rectangular in cross section. Insets can be formed between two adjacent panels in the container sidewall.

24 Claims, 5 Drawing Sheets

U.S. PATENT DOCUMENTS 5,718,348 A * 2/1998 Manera ..... 215/249
D413,265 S 8/1999 Hestehave et al.
6,105,800 A * 8/2000 Czesak ..... 215/42
D458,540 S * 6/2002 Clements et al. ..... D9/516
D468,645 S 1/2003 Nelson et al.
D471,466 S 3/2003 Nelson et al.
D476,234 S 6/2003 Steele, IV et al.
D479,690 S * 9/2003 DeGroff ..... D9/538
6,637,611 B2 * 10/2003 Luch ..... 215/256

FOREIGN PATENT DOCUMENTS

EP 0136222 A2 * 4/1985

* cited by examiner

MOLDED CONTAINER WITH BEADED NECK

CROSS-REFERENCE TO RELATED APPLICATION

This application is a continuation-in-part of U.S. Des. patent application Ser. Nos. 29/156,197 and 29/156,163 now U.S. Pat. No. D. 486,739, each of which was filed Feb. 26, 2002, and are hereby incorporated by reference in their entirety.

BACKGROUND OF THE INVENTION

1. Field of the Invention

The present invention relates generally to neck structures for plastic containers. More particularly, this is a neck structure having a flange with undulations on the top surface that exhibits advantageous top load properties.

2. Related Art

Plastic containers are now in common use for storing foodstuffs, medicine, liquids, and many other materials. These containers must withstand a variety of radial side wall forces and axial top loading forces during manufacture, shipping, storage and use. For example, containers filled using a hot fill process must be rigid enough to resist side wall collapse due to internal vacuums that develop as the hot liquid added to the container cools. As another example, containers are required to withstand radial forces during label application operations.

In addition to radial forces acting on the sides of a container, the container must also resist axial top load forces that act to compress a container. These forces arise at a variety of stages during the manufacture, fillings storage, shipping and display of containers for sales to consumers. For example, after initial manufacture, bottles may be stacked and stored. Although individual bottles are relatively lightweight, the weight of multiple stacks of filled bottles, as typically stored in a warehouse, is large, placing significant pressure or bottles at or near the bottom of the stack. Top load forces also arise during capping operations. During capping, the bottle must resist not only collapse, but also deflection of the neck as the cap is applied. If the neck deflects during the capping operation, the cap will not be properly applied, leaving an opening. This results not only in scrap bottle material, but also in wasted product.

Systems used to transport containers during the manufacturing process frequently lift the container at the neck using a fork-like apparatus. In order to be lifted or transported by the apparatus, the container is manufactured with a flange, also called a transfer bead, located in the neck portion of the container. Because of material flow properties the flange cannot be manufactured as a solid projection without an unacceptable increase in gram weight. Rather, such flanges are typically formed as a hollow outwardly projecting "V", thus having an appearance similar to a single fold of an accordion or bellows. When topload pressures are applied to such a structure, for example during capping operations, the flange tends to fold, which results in a deflection that can lead to misapplication of the cap. This becomes even problematic during hot-fill processing. To overcome this problem, prior art solutions have included the use of larger amounts of material. However, increases in amounts of material, i.e. increases in "gram weight," are undesirable; lightweighting of containers without a deterioration of physical properties can give a manufacturer a significant competitive advantage. Thus, increases in gram weight may result in unacceptable increases in cost.

Plastic containers, especially blow molded plastic containers, are manufactured in various shapes to achieve structural advantages and aesthetic function. Specifically, it is known to provide container side walls with troughs, extensions and decorative shapes to accommodate internal vacuum forces. Inward flexing of the side walls and panels may also be used to accommodate vacuum forces that develop during the hot-fill process. Inward flexing of the side walls accommodate volumetric shrinking but create undesirable corner deformations which reduce structural capability to withstand top loads.

There has also been some focus on the modification of the dome or bell portion of a container to improve top load resistance in that area. There has been less focus on strengthening of the neck portion of containers to improve top load resistance. However, as efforts continue to further reduce the weight of containers, the thinning of walls in the neck can become an important design concern.

There is a continuing need for bottle structures able to resist various forces that act on a container during manufacture, filling and use. The relative lack of focus on strengthening the neck region of plastic containers results in a particular need for designs that improve the load resistance of this area, particularly in regard to capping operations and other manufacturing segments requiring top load strengthening.

SUMMARY OF THE INVENTION

A container neck can include a finish terminating in an opening, an upper sidewall below the finish; a lower sidewall below the upper sidewall; and a flange that extends radially from the neck between the upper and lower sidewall. The flange can have having undulations on its top surface that define peaks and valleys. Exemplary embodiments include eight peaks. The undulations can be arcuate, forming an approximately sinusoidal wave at the point of connection with said upper sidewall. Alternatively, undulations can have linear sides and a forming a substantially triangular shape ate the point of connection with said upper sidewall. The flange can have a ledge extending beyond the outer periphery of said undulations. The finish can have threads on an outer surface.

A container can include the neck described above, together with a transition region extending from the neck portion to a tubular container sidewall portion and a base portion below the container sidewall portion. The container sidewall can be made up of four substantially planar panels wherein opposite planar panels are substantially parallel, thus forming a rectangular or square shape. The container sidewall can also include an arcuate panel connecting two adjacent planar panels. An inset can be present between two adjacent planar panels; for example, in an arcuate panels. Further, additional insets may be present, for example two insets on located diagonally from on another. The container can be adopted for hot fill processing.

In another aspect, a container can be made up of four substantially planar panels wherein opposite planar panels are substantially parallel, thus forming a rectangular or square shape, with an arcuate panel connecting two adjacent planar panels. An inset can be present between two adjacent planar panels; for example, in an arcuate panels. Containers of this type may or may not include the neck portion described above. Further, additional insets may be present, for example two insets can be located diagonally from on another. The container can be adopted for hot fill processing.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

Figure 1:
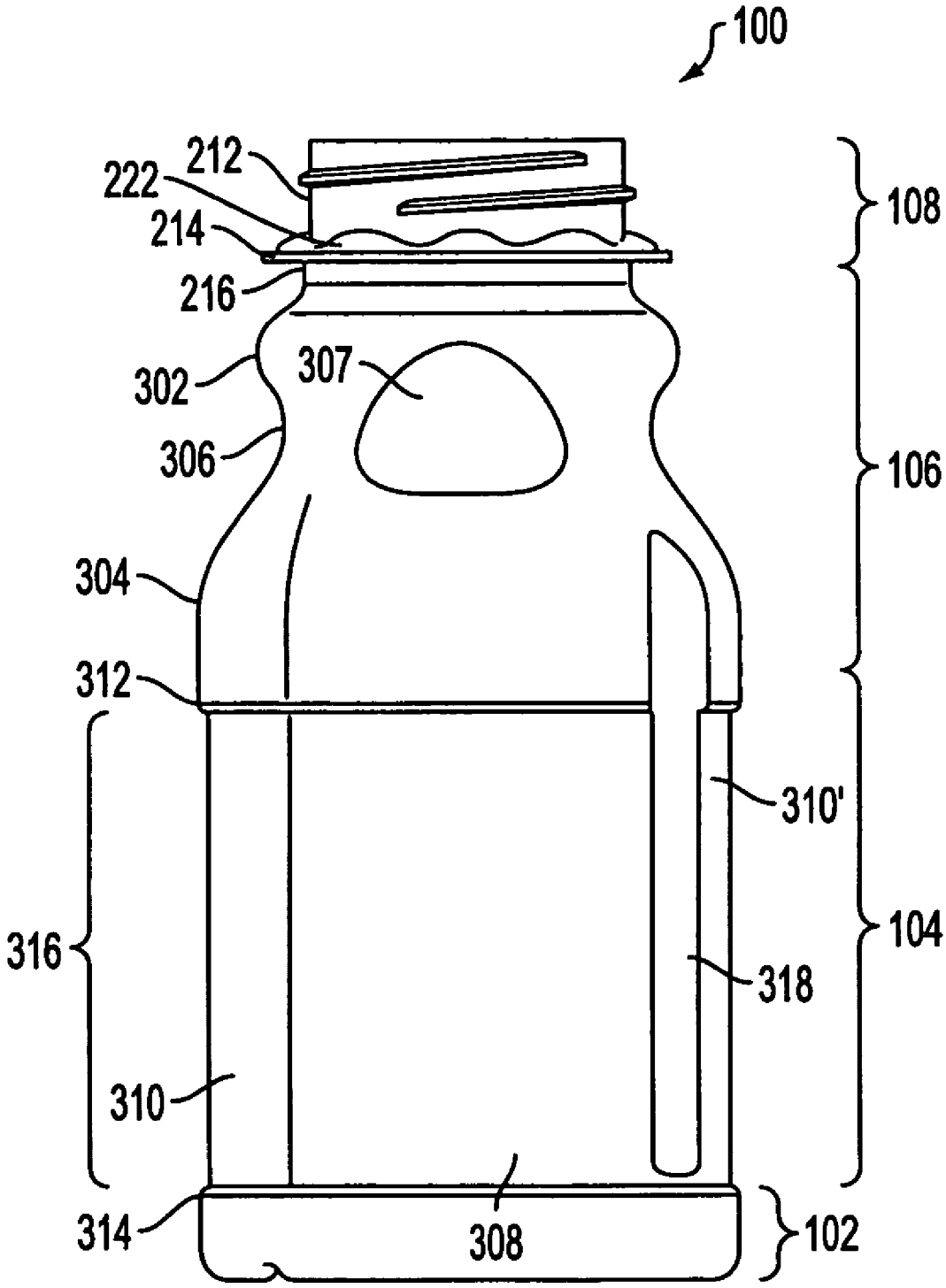
FIG. 1 illustrates a plastic container that includes a container neck portion according to the present invention.

FIG. 1 illustrates a plastic container 100 that includes a container neck according to the present invention. The container 100 has a base portion 102, a tubular container sidewall 104 extending vertically from the base portion 102 to a transition region 106 that connects to a neck portion 108. The transition portion 106 can connect the container sidewall 104 and the neck portion 108, particularly where the neck portion 108 and container sidewall 104 have different diameters or shapes. The transition portion 106 can comprise a dome or bell. The neck portion 108 terminates in an opening 110 at the end opposite the container sidewall 104.

Figure 2:
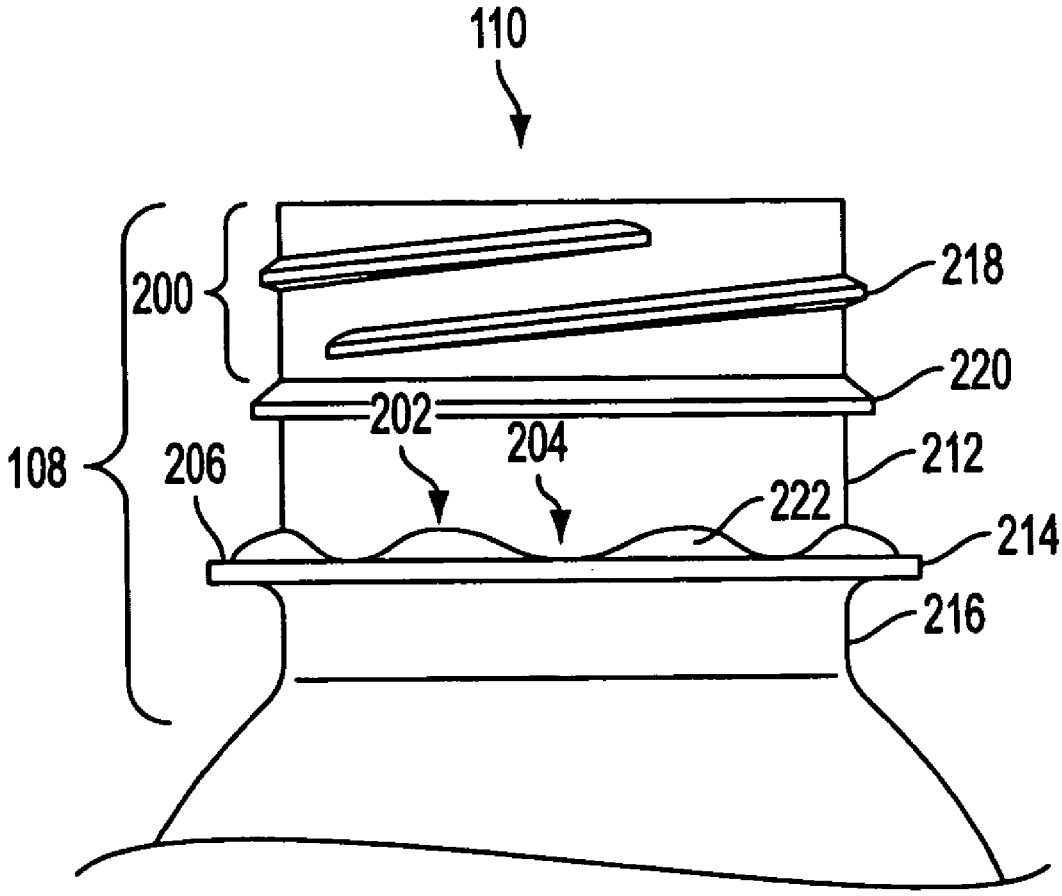
FIG. 2 is a diagram of a container neck portion according to an exemplary embodiment of the invention.

FIG. 2 is a diagram of a container neck portion 108 according to an exemplary embodiment of the invention. The neck portion 108 includes a finish 200 that connects the opening 110 to an upper vertical sidewall 212, which in turn connects to a flange 214 extending radially outward from the upper vertical sidewall 212. A lower vertical sidewall 216 can extend from below the flange 214 to the transition region 106 of the container. The finish 200, upper vertical sidewall 212, and lower vertical sidewall 216 can be of the same diameter, giving the appearance of a continuous vertical sidewall extending from the opening 110 to the transition region 106. However, it is not necessary that the lower vertical sidewall 216, upper vertical sidewall 212 and finish 200 have the same diameter; one, two or all three of the components may have different diameters. The present invention is not limited by the particular relationship of the diameters of the finish 200, upper vertical sidewall 212, and lower vertical sidewall 216. The finish 200 can further include threads 218, or other structures for attaching a cap (not shown). Other structures that might be used to attach a cap can include, but are not limited to, rings for friction fit or snap fit engagement of a cap. Further, neck portion 108 can include other structures, for example a cap ring 220 that can function to limit the placement of a cap or act as a partition between the main portion of a cap and a tamper evident band. Such rings and their uses are known in the art and readily useable with the present invention.

In order to withstand downward forces imposed during capping of plastic containers, the neck portion of the container requires topload strength to prevent collapse. The need for topload strength of the neck portion during capping operations can be particularly important for containers with threaded neck portions adapted for use with a threaded cap. For example, application of a threaded cap by pressing the cap onto, rather than twisting the cap onto, a container with a threaded finish simplifies the capping process. However, pressing a threaded cap onto the container can result in greater topload force being applied to the container as compared to twisting. The forces incurred can also be larger than those encountered when placing a snap fit or friction fit cap onto the container.

In order to strengthen the neck portion 108 of a container, the present invention provides that the top surface of the flange 214 be formed in a manner to create a series of peaks 202 and valleys 204 resulting in undulations 222 disposed around an outer circumference of the upper sidewall 212 of the neck portion 108 on the flange 214. The undulations 222 are formed of the same material as the remainder of the container 100 during the container forming process. The undulations 222 aid in the prevention of deflection of the components of the neck portion 108 during capping operations or when other top load pressure is applied. The exemplary structure having a flange 214 and undulations 222 is useful in containers intended for a wide variety of applications, including containers filled above room temperature by hot-fill processes, below room temperature in cold-fill operations or at ambient temperature. In addition, the neck structure of the present invention can be used in containers of any size and shape. Thus, the base portion 102, container sidewall 104 and transition region 106 can be of any shape.

As a point of reference, in prior art containers having a V-shaped flange, the upper part of the "V" connects to the upper vertical sidewall at about a point analogous with the position at which the peaks 202 connect with the upper vertical sidewall 212. Thus, the flange in prior art containers is, overall, a wider structure than a flange according to the present invention, incorporating the entire undulating surface. Conceptually, the undulations 222 of the present invention are sculpted into the top surface of a flange that would typically be present according to the prior art, thus creating depressions. The depressions result in the formation of the valleys 204, and the peaks 202 are conceptually the top of the original flange. Of course, because the undulations are formed in a unitary molding process, depression of a flange is only a conceptual tool for visualizing the invention.

Manufacture of a neck portion according to the present invention also results in a narrowing at the extremity of the flange 214, that gives the appearance of a flat flange with undulations superimposed thereon. Such a flat structure is generally not achievable during a blow molding process due to problems with material flow. However, the presence of the undulations on the top surface of the flange helps overcome these material flow problems, permitting formation of a more compressed flange. This flattening of the flange further improves top load performance because it is less compressible than a V-shaped flange present in prior art containers.

Figure 6:
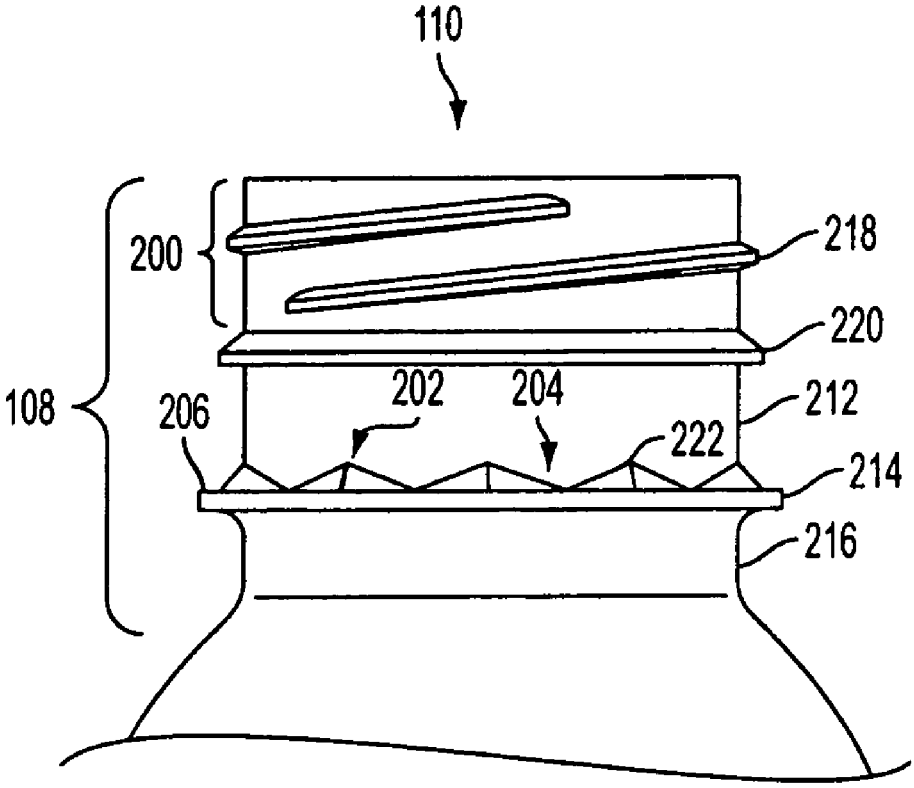
FIG. 6 illustrates a plastic container that includes a container neck portion including linear undulations according to an exemplary embodiment of the present invention.

It is believed that the undulations 222 defined by the peaks 202 and the valleys 204 in the top surface of the flange 214 support the neck portion 108 by acting as buttresses joining the flange to the upper vertical sidewall 212. The presence of a ledge 206 that extends beyond the surface undulations 222 can bolster this buttressing effect. Although the buttresses are depicted herein as arcuate, rounded structures, the same advantages can be achieved by other shapes. For example, as shown in FIG. 6, the undulations 222 have more linear sides, i.e., creating substantially triangular projections. Further, the undulations 222 depicted herein as being connected to form a substantially continuous structure, so that the point of contact between the upper vertical sidewall 212 and the undulations 222 can be traced to form a sinusoidal wave around the neck of the container. However, the valleys 204 can be formed such that the undulations 222 are discontinuous or unconnected so that the flange 214 has flat portions in between the base of two adjacent undulations 222.

The exemplary embodiments of the neck portion of the invention depicted herein contain undulations 222 forming eight peaks 202 disposed above the flange 214 at its junction with the upper vertical sidewall 212. The invention is not limited to the use of eight peaks, but any number of peaks can be used so long as adequate top load resistance, i.e. sufficient support to prevent deflection, collapse, or misshaping of the neck portion 108 and/or transition region 108, for the desired application is achieved.

Figure 3:
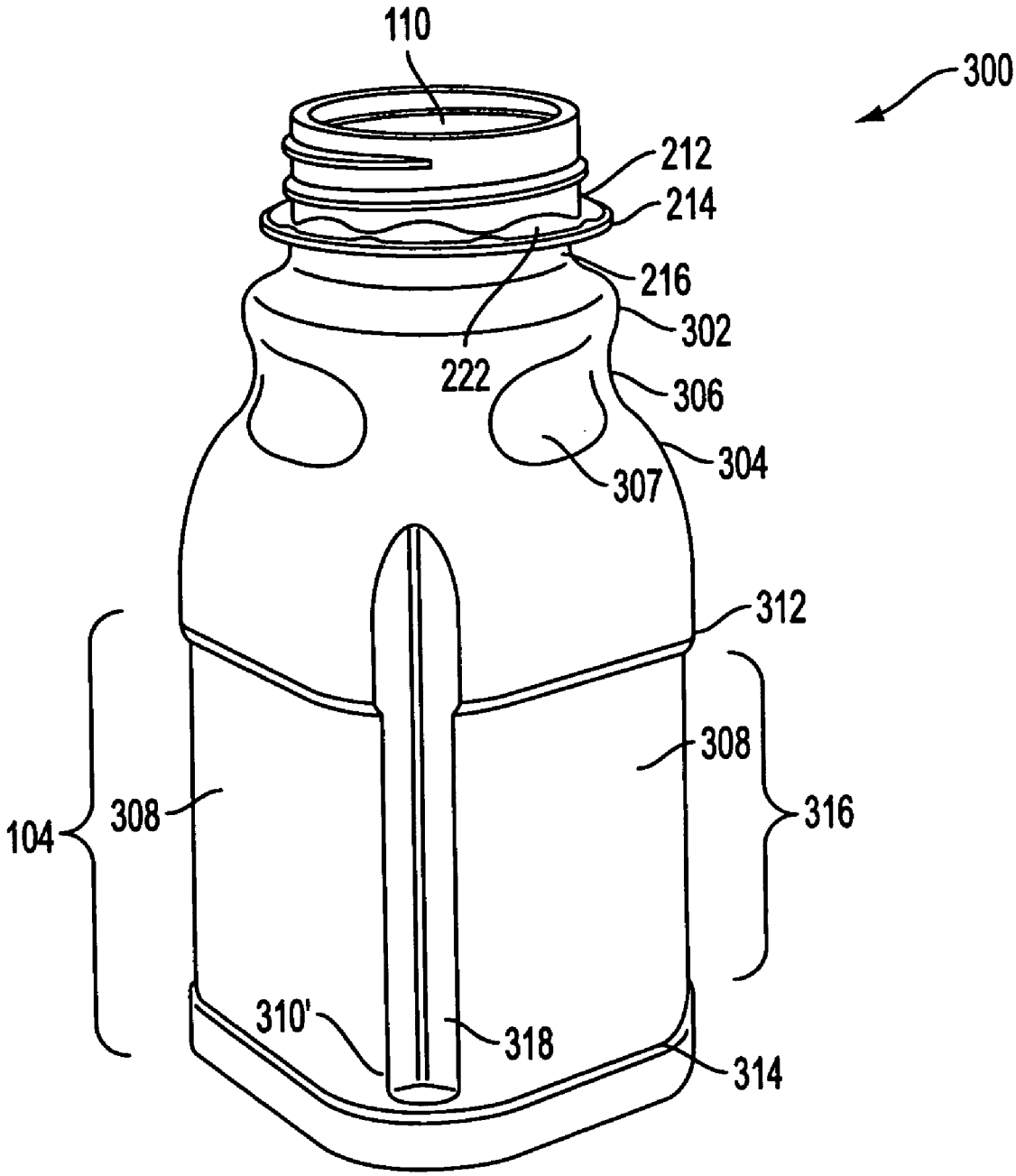
FIG. 3 is a perspective view of the container of FIG. 1 according to the exemplary embodiment of the invention.
Figure 4:
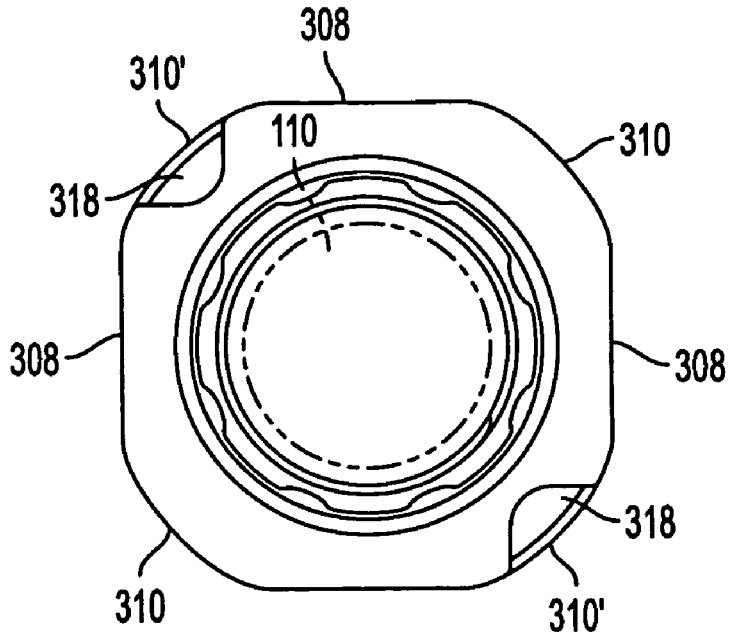
FIG. 4 is a top view of the container of FIG. 1 according to the exemplary embodiment of the invention.
Figure 5:
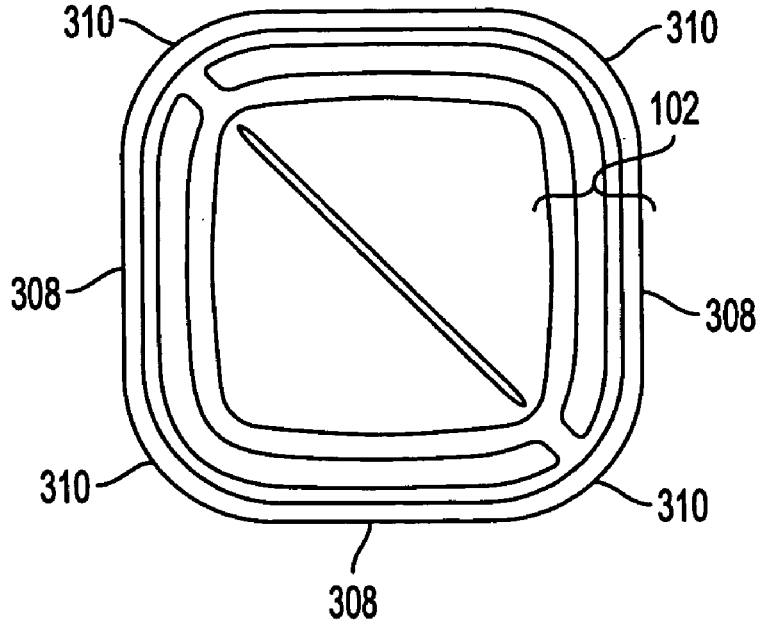
FIG. 5 is a bottom view of the container of FIG. 1 according to the exemplary embodiment of the invention.

FIGS. 3, 4 and 5 are perspective, top and bottom views, respectively of the container 100 according to the exemplary embodiment of the invention depicted in FIG. 1. The neck portion 108 of this exemplary embodiment is substantially cylindrical, whereas the container sidewall portion 104 is rectangular or square. Further, the circumference of the cylinder forming the neck portion 108 differs in size from the periphery of the container sidewall 104. As a result, the transition region 106 accommodates both a change in shape and a change in size. The transition region in the illustrated embodiment includes an upper shoulder 302, a lower shoulder 304 and a waist 306 disposed between them. The present invention is not limited to this structure for the transition region; any suitable configuration can be used.

The container sidewall 104 of the depicted embodiment is made up of four substantially planar panels 308. As seen in FIGS. 4 and 5, opposite planar panels 308 are generally parallel, so that the container is generally rectangular or square in cross section. The container sidewall 104 can further include arcuate panels 310 disposed between adjacent pairs of planar panels 308. A cross section of the container thus appears as flat panels connected by an arcing panel, or as a square with rounded corners. (See FIGS. 4 and 5) As shown in FIG. 3, the container sidewall 104 can also include an upper bumper 312 and lower bumper 314. The upper and lower bumpers 312, 314 can be present around the entire periphery of the container sidewall 104, as shown in the depicted embodiment, or can be present on only the planar 308 or arcuate 310 panels. The container sidewall 104 is recessed in the region 316 between the upper and lower bumpers 312, 314 relative to the remainder of the container sidewall 104. As is well known in the art, this recessed region 316 can form a label panel between the upper and lower bumpers 312, 314, with the upper and lower bumpers 312, 314 defining the placement of the label and restricting its vertical movement. Suitable labels can be glued onto the container in the inset region 316 or a shrink-wrap label can be applied. Each of these techniques is well known in the art. The transition region 106 of the container 100 further includes a logo region 307 for placement of a logo or other product identification means, including a label.

The arcuate panels 310, 310' of the illustrated embodiment can be of two different types. A first set of arcuate panels 310 form uninterrupted arcs; and, a second set of arcuate panels 310' form arcs that are interrupted by an inset 318. The inset 318 has an arcuate shape that is concave with respect to the outside of the container. The illustrated embodiment has two insets 318 on arcuate panels 310' that are disposed diagonally from one another. As will be appreciated, other embodiments can include only one inset 318 and associated arcuate panel 310', or can include a pair of insets 318 and arcuate panels 310' disposed on opposite sides of a single planar panel 308. As can also be seen, the inset 318 in the illustrated embodiment extends beyond the container sidewall 104 and into the transition region 106 to form a continuous channel throughout the height of the container.

The inset 318 can be useful in product packaging and can be used with or without the neck portion described herein. For example, if a shrink-wrap label is applied to the container 300, a void is formed between the inset and the label. This void can be used to hold, for example, a spoon or a straw to be used with the product contained in the container. For example, a straw can be wrapped in its own packaging, for example a plastic wrap, and inserted in the void. This packaged straw can be held in the void by friction or glue. Because the channel formed by the inset 318 extends beyond the container sidewall 104 and into the transition region 106, the straw can be longer than the container sidewall and can be used for drinking from the container. This type of use is particularly applicable to juices and other drink products. As another example, the void formed by the inset 318 can be used to hold a spoon by inserting the handle for the spoon into the void. The spoon can then be used to scoop a solid material, such as a powder, or a semi-solid or viscous material from the container. This can also be useful for packaging medicines, where the spoon is adapted to hold a single dose or to measure a dosage. The void can then function as a holder for the spoon between doses.

Containers having the beaded neck configuration of the present invention can be manufactured using standard techniques for molding plastic containers. The plastic container can be made of any suitable plastic material, such as thermoplastic materials including nylon; polyolefins such as polyethylene or polypropylene; polyesters such as polyethylene terephthalate; and polycarbonates. Plastic containers can be formed by any suitable method known in the art including, but not limited to, extrusion, extrusion blow molding, stretch blow molding, injection molding and injection blow molding. In an exemplary embodiment, the container is extrusion blow molded polyethylene.

Containers having a neck portion that includes a flange 214 and undulations 222 according to the present invention are molded in a unitary operation with the rest of the container, including the base portion 102, container sidewall 104, and transition region 106, in a suitable molding process described above. As previously stated, although a particular shape of container is depicted, the neck portion of the invention can be used in a wide variety of containers regardless of the shapes of the base 102, container sidewall 104, and transition region 106.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A container neck comprising:

a finish terminating in an opening;

a circumferential upper sidewall connected to said finish at an end opposite said opening;

a lower sidewall below said upper sidewall; and a hollow annular flange extending radially outwardly between said upper and said lower sidewalls, wherein the flange includes undulations in a top surface thereof, at least a portion of the undulations extending radially outwardly and downwardly from said upper sidewall to strengthen the container neck.

2. The container neck of claim 1, wherein said undulations comprise peaks and valleys.

3. The container neck of claim 2, wherein said undulations have linear sides and a substantially triangular shape.

4. A container neck of claim 2, comprising eight peaks.

5. The container neck of claim 2, wherein said undulations are arcuate.

6. The container neck of claim 5, wherein said undulations form an approximately sinusoidal wave at the point of connection with said upper sidewall.

7. The container neck of claim 1, further comprising threads disposed on an outer surface of said finish.

8. The container neck of claim 1, wherein said flange comprises a ledge extending beyond an outer periphery of said undulations.

9. The container neck of claim 1, wherein the container is adapted for hot-fill processing.

10. A container comprising a neck portion comprising a finish terminating in an opening;

a circumferential upper sidewall connected to said finish at an end opposite said opening;

a lower sidewall below said upper sidewall; and a hollow annular flange extending radially outwardly between said upper and said lower sidewalls, wherein the flange includes undulations in a top surface thereof, at least a portion of the undulations extending radially outwardly and downwardly from said upper sidewall to strengthen the neck portion;

a transition region extending from the neck portion to a tubular container sidewall portion; and a base portion below said container sidewall portion.

11. The container of claim 10, wherein said undulations are arcuate.

12. The container of claim 11, wherein said undulations form an approximately sinusoidal wave at the point of connection with said upper sidewall.

13. The container of claim 10, wherein said undulations are linear forming a triangular shape.

14. The container of claim 10, further comprising threads disposed on an outer surface of said finish.

15. The container of claim 10, wherein said undulations comprise peaks and valleys.

16. The container of claim 10, wherein the container is adapted for hot fill processing.

17. The container of claim 10, wherein said flange comprises a ledge extending beyond an outer periphery of said undulations.

18. The container of claim 15, comprising eight peaks.

19. The container of claim 10, said container sidewall portion comprising four substantially planar panels wherein opposite planar panels are substantially parallel.

20. The container of claim 19, wherein the container sidewall portion comprises an inset between two adjacent planar panels.

21. The container of claim 19, wherein said container sidewall portion comprises an arcuate panel connecting two adjacent planar panels.

22. The container of claim 21, further comprising an inset in the arcuate panel between two adjacent panels.

23. The container of claim 22, comprising two insets in arcuate panels that are diagonally disposed from one another.

24. The container of claim 10, said container sidewall comprising an upper bumper and a lower bumper and an inset region between said upper bumper and said lower bumper.

* * * * *